US012202644B2

(12) United States Patent
Dehghan-Manshadi

(10) Patent No.: US 12,202,644 B2
(45) Date of Patent: Jan. 21, 2025

(54) HOLE-IN-THE-GROUND BEVERAGE COOLER

(71) Applicant: FEDERTEC PRODUKTIONS-GMBH, Solingen (DE)

(72) Inventor: Constantin Dehghan-Manshadi, Solingen (DE)

(73) Assignee: FEDERTEC PRODUKTIONS-GMBH, Solingen (DE)

( * ) Notice: Subject to any disclaimer, the term of this patent is extended or adjusted under 35 U.S.C. 154(b) by 0 days.

(21) Appl. No.: 18/033,155

(22) PCT Filed: Oct. 18, 2021

(86) PCT No.: PCT/EP2021/078790
§ 371 (c)(1),
(2) Date: May 11, 2023

(87) PCT Pub. No.: WO2022/084242
PCT Pub. Date: Apr. 28, 2022

(65) Prior Publication Data

US 2023/0406573 A1 Dec. 21, 2023

(30) Foreign Application Priority Data

Oct. 23, 2020 (DE) ..... 10 2020 128 004.1

(51) Int. Cl.
*A47G 23/02* (2006.01)
*B65D 25/10* (2006.01)
*B65D 25/28* (2006.01)

(52) U.S. Cl.
CPC ..... *B65D 25/108* (2013.01); *B65D 25/28* (2013.01)

(58) Field of Classification Search
CPC ..... A47G 23/02; A47B 73/004; B65D 25/108
USPC ..... 220/484
See application file for complete search history.

(56) References Cited

FOREIGN PATENT DOCUMENTS

| | | | |
|---|---|---|---|
| DE | 20 2004 005 371 | U1 | 6/2004 |
| EP | 2 470 451 | B1 | 7/2012 |
| FR | 2 788 752 | A1 | 7/2000 |

OTHER PUBLICATIONS

Anonymous. "HopfenHohle—Was ist das? Welche Versionen gibt es? HopfenHohle.de"; Mar. 22, 2017 (Mar. 22, 2017); pp. 1-5; Retrieved from the Internet: https://xn-hopfenhhle-kcb.de/infos/ [retrieved on Jan. 31, 2022] XP055885244 with English translation.

(Continued)

*Primary Examiner* — Stephen J Castellano
(74) *Attorney, Agent, or Firm* — Collard & Roe, P.C.

(57) ABSTRACT

Disclosed is a hole-in-the-ground beverage cooler, comprising a plastic jacket tube which can be inserted vertically into a hole in the ground and which is provided at the bottom with a tightly sealing base and at the top with a removable cover, and in the interior of which jacket tube a support device is situated that can be moved axially upwards and out of the jacket tube, on which support device a plurality of axially-spaced-apart disc-shaped beverage holders are fastened. The beverage holders can be slid into the jacket tube and are each provided with a plurality of hooking-in openings for hooking in the necks of beverage bottles, which hooking-in openings are distributed around the circumference of the beverage holder and are accessible from the periphery.

14 Claims, 9 Drawing Sheets

(56) References Cited

OTHER PUBLICATIONS

Benny Kristensen. "Cool-Well Ølkøler—Anmeldelse og test af ølhullet"; Aug. 30, 2014 (Aug. 30, 2014); pp. 1-9; Retrieved from the Internet: https ://www.bennykristensen.com/cool-well-oelkoeler/; [retrieved on Jan. 31, 2022]; XP055885238 with English translation.

Anonymous. "HopfenHohle—Was ist das? Welche Versionen gibt es? HopfenHohle.de"; Mar. 22, 2017 (Mar. 22, 2017); pp. 1-5; Retrieved from the Internet: https://xn-hopfenhhle-kcb.de/infos/ [retrieved on Jan. 31, 2022] XP055885244.

Anonymous. "EASYmaxx 07787 Outdoor Bottle Cooler. Retractable Drinks Cooler for a Hole 1-14 in the Ground, Cold Drinks without Electricity, for Garden, Camping, Beach, Festivals and Much More, Grey: Amazon.co.uk: Home & Kitchen" Jun. 25, 2017 (Jun. 25, 2017). pp. 1-5; Retrieved from the Internet: https://www.amazon.co.uk/EASYmaxx-07787-Retractable-Earthhole-Festivals/dp/B06XW8Z9J8 [retrieved on Jan. 31, 2022] XP055885237.

Benny Kristensen. "Cool-Well Ølkøler—Anmeldelse og test af ølhullet"; Aug. 30, 2014 (Aug. 30, 2014); pp. 1-9; Retrieved from the Internet: https ://www.bennykristensen.com/cool-well-oelkoeler/; [retrieved on Jan. 31, 2022]; XP055885238.

International Search Report in PCT/EP2021/078790 dated Feb. 8, 2022 with English translation.

Examination Repont in German Patent No. DE 10 2020 128 004 B3 dated Sep. 15, 2021 with English translation.

HOLE-IN-THE-GROUND BEVERAGE COOLER

CROSS REFERENCE TO RELATED APPLICATIONS

This application is the National Stage of PCT/EP2021/078790 filed on Oct. 18, 2021, which claims priority under 35 U.S.C. § 119 of German Application No. 10 2020 128 004.1, filed on Oct. 23, 2020, the disclosure of which is incorporated by reference. The international application under PCT article 21(2) was not published in English.

The invention relates to a hole-in-the-ground beverage cooler with a jacket tube of plastic, which can be inserted vertically into a hole in the ground, which is equipped at the bottom with a tightly sealing base and at the top with a lift-off cover and in the inner space of which a carrying device is disposed that can be moved axially upward out of the jacket tube and on which several disk-shaped beverage holders, which have axial distance from one another and can be pushed into the jacket tube, are fastened that are respectively equipped with several hanger openings disposed in distributed manner over their circumference and accessible from the periphery for hanging the bottle necks of beverage bottles.

Such hole-in-the-ground beverage coolers are known according to the prior art (see Internet http://www.hopfen-hoehle.de). In the already known hole-in-the-ground beverage coolers, the particular configuration of the disk-shaped beverage holders means that only the spaces underneath the respective beverage holders can be utilized, but not the spaces above these beverage holders. This circumstance always leads, on the one hand, to a relatively poor space utilization of the interior space of the jacket tube and, on the other hand, to the fact that beverage containers that have no bottle neck, such as, for example, beverage cans, cuboid containers of cardboard, etc., cannot be fixed sufficiently stably on the disk-shaped beverage holders, especially not in the spaces above their plane of extension.

It is the task of the invention to further develop the hole-in-the-ground beverage cooler of the type mentioned in the introduction to the effect that the interior space of its jacket tube can be better utilized and that, in addition to bottles with bottle necks, other beverage containers with different shapes and dimensions can also be securely placed on the beverage holders.

For accomplishment of this task, the invention proposes, starting from a hole-in-the-ground beverage cooler of the type mentioned in the introduction, that the beverage holders be respectively equipped above the hanger openings with cylinder-shell-shaped bracing walls, open toward the periphery of the beverage holder, for bracing of beverage containers, which can be inserted from above into the beverage holder.

The beverage holders configured according to the teaching of the invention still permit, on the one hand, the hanging of bottle necks from the side, and specifically of bottles hanging down into the space below the respective beverage holder, and, on the other hand, the insertion of beverage containers of any desired shape, e.g. beverage cans, cuboid beverage containers of cardboard, etc., which can be inserted from above into the receiving spaces between the cylinder-shell-shaped bracing walls and thus utilize the space above the respective beverage holder. The hole-in-the-ground beverage cooler according to the invention is therefore suitable for the first time for almost all commercial beverage containers, and beyond that utilizes the space available in the jacket tube more effectively.

An expedient further development of the invention provides that the cylinder-shell-shaped bracing walls of the beverage holders have a radius of curvature that increases stepwise with increasing distance from the hanger openings. Hereby it is even more readily possible to insert beverage containers with different diameters from above into the beverage holders and to brace them stably on the beverage holders.

Expediently, the beverage holders are respectively manufactured as one-piece castings of plastic and are therefore suitable for mass production.

In order to be able to utilize the spaces between the individual beverage holders even more effectively and to adapt them better to beverage containers of different heights, it is further provided that the carrying device has a carrying bar, which can be moved axially out of the jacket tube and on which the beverage holders can be displaced in axial direction and fixed in infinitely variable position. In this way, it is possible for the first time to adapt the distances between the successive beverage holders to the respective requirements in simple manner and, in fact, with few manipulations and without any assembly effort, for example during loading of the hole-in-the-ground beverage cooler with bottles and/or other beverage containers.

Incidentally, this infinitely variable displaceability and fixability of beverage holders on the carrying bar of a holding device of hole-in-the-ground beverage coolers is useful even if the beverage holders themselves are designed conventionally and according to the prior art.

One embodiment of the invention that enables this infinitely variable adjustment provides that the beverage holders respectively have a central passage opening for the carrying bar, and that a clamping spring bracing the beverage holder and clamping it securely to the carrying bar at any desired height is respectively disposed underneath the beverage holder. During the use of such a clamping spring, only this clamping spring needs to be displaced along the carrying bar in axial direction and in this way it fixes the beverage holder on the carrying bar at the respective correct height.

The said clamping springs are expediently designed as leg springs having several spring coils bearing axially against one another and surrounding the carrying bar, and their inside diameter is smaller than the outside diameter of the carrying bar when the clamping spring is relaxed, wherein the upper spring leg of this clamping spring is braced in twist-proof manner on the underside of the beverage holder and the lower spring leg of this clamping spring is designed as a handle, which serves to transmit a torque that tensions the leg spring.

A clamping spring designed and arranged in this way enables the displacement and fixation of the beverage holders on the carrying bar at respectively any desired height exceptionally effectively. For this purpose, it is sufficient with one hand to hold the beverage holder securely and with the other hand to transmit, to the clamping spring, by means of the lower spring leg, which is designed as a handle, a torque that tensions the clamping spring. Hereby the threads of the clamping spring bearing on the outer circumference of the carrying bar are raised away from the outer circumference of the carrying bar, so that the clamping spring can be readily moved in axial direction of the carrying bar. For fixation in the changed position, it is sufficient to release the lower spring leg of the clamping spring, which is designed as a handle, whereby the threads of the clamping spring are again held securely with high contact force on the outer circumference of the carrying bar.

For a particularly simple configuration of the connection between the upper spring leg of the clamping spring and the respective beverage holder in a manner particularly well suited to assembly and disassembly, it is provided that receiving openings for the accommodation and fixation of the upper spring leg of a clamping spring are respectively disposed on the undersides of the beverage holders, wherein these receiving openings respectively have at least one undercut, in which the upper spring leg can be elastically latched.

A particularly simple and inexpensive embodiment of the hole-in-the-ground beverage cooler according to the invention provides that the carrying bar has a handle at its upper end for lifting out the entire carrying device together with the beverage holders fastened on it and loaded with beverage containers.

A substantially more convenient embodiment of the hole-in-the-ground beverage cooler according to the invention provides that the carrying bar is connected to the cover of the jacket tube and is equipped with a pneumatic spring, which serves to lift the carrying device out of the jacket tube and is braced on the base of the jacket tube. Such a pneumatic spring, which is tensioned by pressing the carrying device loaded with beverage containers down into the jacket tube, automates the lifting-out process to a certain extent.

In this case, the pneumatic spring is expediently provided with a depressible switching element for release and locking of the pneumatic spring in alternating succession. The pressing down and the lifting out of the carrying device with assistance of the pneumatic spring then takes place in a manner somewhat analogous to the actuating mechanism of a ballpoint pen.

Alternatively to actuation with pneumatic springs, the carrying device may also be assigned an electric rotary spindle drive braced on the base of the jacket tube and used for lifting of the carrying device out of the jacket tube or for lowering of the carrying device into the jacket tube. In this case, the carrying device is expediently guided additionally in twisting-proof manner on the wall of the jacket tube in order to prevent the carrying device from being unintentionally twisted relative to the jacket tube by the rotary spindle drive.

It is further particularly expedient if the base sealing the jacket tube tightly at the bottom is designed as a solid metal plate screwed together with the jacket tube. Such a metal base plate ensures, on the one hand, a rapid heat dissipation into the surrounding cool ground in a manner that assists the cooling process and, on the other hand, forms a stable bracing platform for the bracing of the pneumatic spring or of the electric rotary spindle drive, if these are used.

Finally, if the pneumatic spring discussed above is used, it is provided that, for avoidance of jamming, the bracing of the pneumatic spring or of the spindle of the electric rotary spindle drive on the base of the jacket tube takes place via a ball joint. This ball joint is also used in the manual variant. Thus the retrofitting of the pneumatic spring is possible without tools.

Exemplary embodiments of the invention will be explained in the following on the basis of the attached drawings, wherein:

FIGS. 1*a*, 1*b* and 1*c* schematically show in side view hole-in-the-ground beverage coolers according to the invention in three different embodiments;

Figure 10:
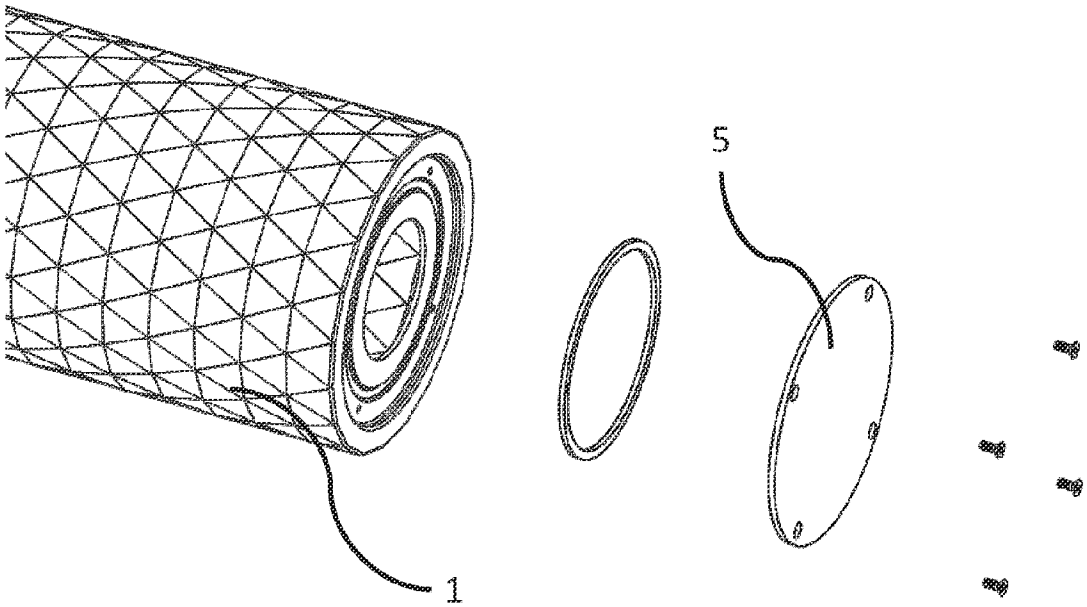
FIG. 10 shows the fastening of the metal base on the jacket tube in exploded representation.

In the drawing, the jacket tube of a hole-in-the-ground beverage cooler according to the invention, inserted into a hole in the ground and manufactured from a suitable plastic, is denoted by the reference symbol 1. A carrying device 2, which is equipped with several disk-shaped beverage holders 3 disposed at axial distance from one another and carried by a carrying bar 4 that can be extended upward out of the jacket tube 1, can be inserted from above into the interior space of this jacket tube 1. The jacket tube 1 is screwed at its lower end together with a tightly sealing metal base 5 (see FIG. 10) and can be closed at its upper end by means of a removable cover 6 (see FIGS. 1*a*, 1*b* and 1*c*) when the carrying device 2 is inserted.

The beverage holders 3 illustrated in detail in FIGS. 2-5 are respectively equipped with several hanger openings 7*a*, 7*b*, 7*c* and 7*d*, which are disposed in distributed manner on their circumference, are accessible from the periphery and are respectively used for hanging of the bottle necks of beverage containers 8 (for example, beer bottles or champagne bottles 8*a*). Above these hanger openings 7*a*, 7*b*, 7*c* and 7*d*, the beverage holders 3 are further equipped with cylindrically curved bracing walls 9*a*, 9*b*, 9*c* and 9*d*, which are open toward the periphery of the beverage holder 3 for bracing any desired beverage containers 8 (e.g. 8*b* or 8*c*) of different diameters, which containers are respectively inserted from above into the beverage holder 3. These bracing walls 9*a*, 9*b*, 9*c* and 9*d* respectively have a radius of curvature increasing stepwise with increasing axial distance from the hanger openings 7*a*, 7*b*, 7*c* and 7*d* and are accordingly well adapted to beverage containers 8 of different diameters.

For fastening of the beverage holder 3 on the carrying bar 4, the beverage holders 3 are respectively provided centrally with a passage opening 10 for the carrying bar 4. Furthermore, clamping springs 11, which can be clamped securely at any desired height position on the outer circumference of the carrying bar 4 and fix the beverage holder 3 disposed above it, serve for fixation of the beverage holder 3 on the carrying bar 4.

For this purpose, the clamping springs 11 are designed as leg springs having several spring coils 11*a* bearing axially against one another and surrounding the carrying bar 4, and their inside diameter is smaller than the outside diameter of the carrying bar 4 when the clamping spring 11 is relaxed, wherein the upper spring leg 11*b* of this clamping spring 11 is braced in twist-proof manner on the underside of the beverage holder 3 and the lower spring leg 11*c* of this clamping spring 11 is designed as a handle, which serves to transmit a torque that tensions the clamping spring 11.

Figure 8:
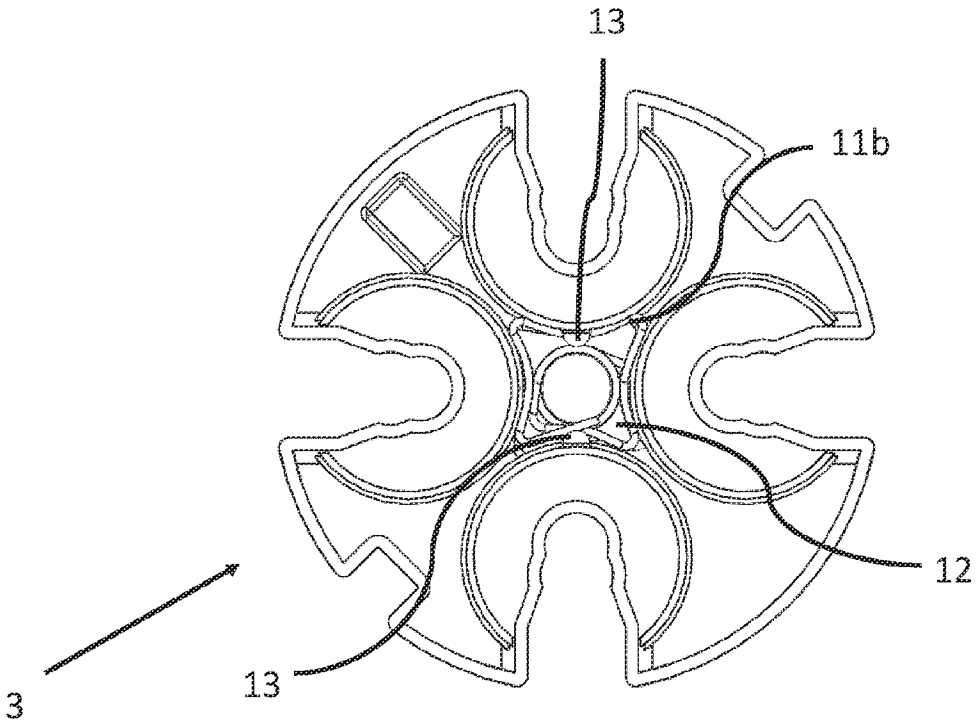
FIG. 8 shows a view of a beverage container with inserted clamping spring from underneath.
Figure 9:
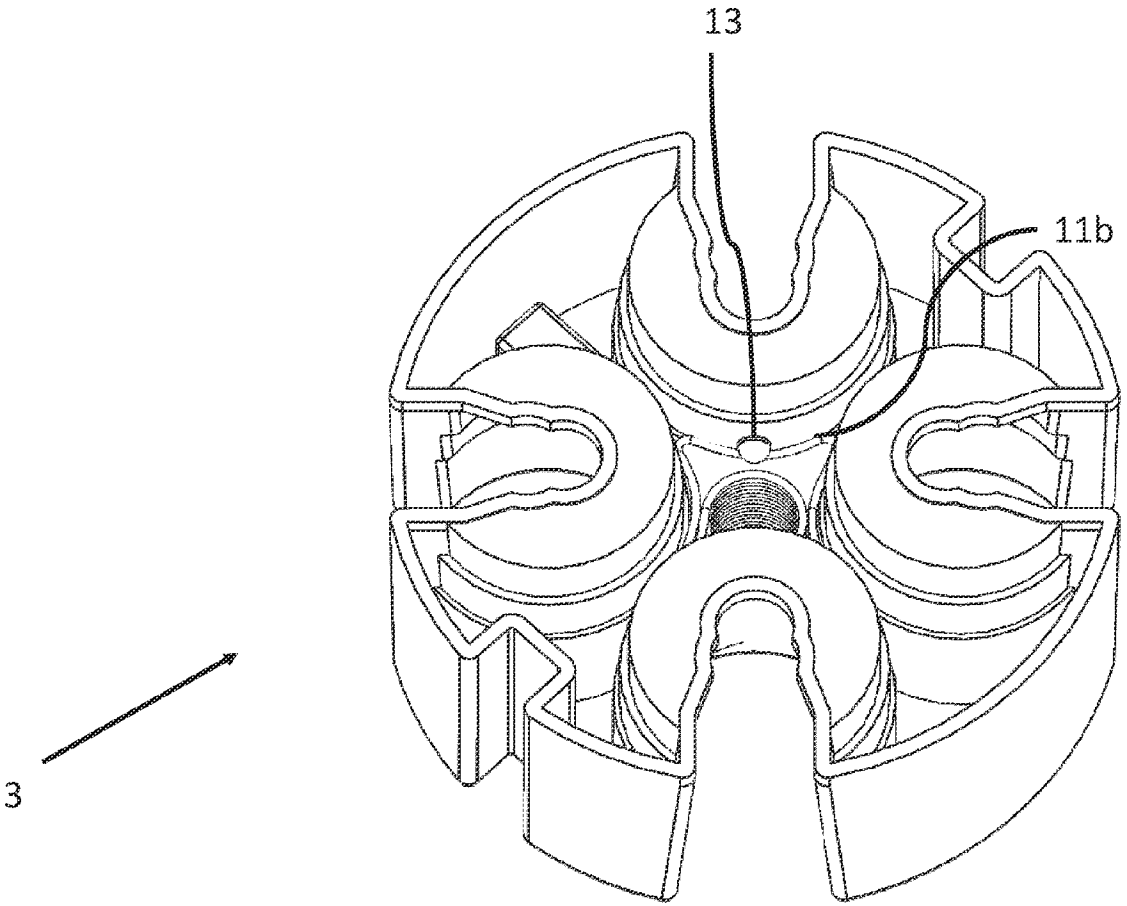
FIG. 9 shows a perspective view corresponding to FIG. 8.

For fixation of the upper spring leg 11*b* of the clamping spring 11 on the underside of the beverage container 3, receiving openings 12 for the accommodation and fixation of this spring leg 11*b* are provided respectively on the underside of the beverage holder 3, wherein these receiving openings 12 respectively have at least one undercut 13, in which the upper spring leg 11*b* of the clamping spring 11 can be elastically latched (see FIGS. 8 and 9).

For displacement and fixation of a beverage container 3 at the respectively desired height position on the carrying bar 4, it is sufficient with one hand to hold the beverage holder 3 securely and with the other hand to transmit, to the clamping spring 11, by means of the lower spring leg 11*c* of the clamping spring 11, which is designed as a handle, a torque that tensions the clamping spring 11. Hereby the threads 11*a* of the clamping spring 11 bearing on the outer circumference of the carrying bar 4 are raised away from the outer circumference of the carrying bar 4, so that the clamping spring 11 can be moved directly in axial direction of the carrying bar 4. For fixation in the changed position, it is sufficient to release the lower spring leg 11*c* of the clamping spring 11, which is designed as a handle, whereby the threads 11*a* of the clamping spring 11 are again secured with high contact force on the outer circumference of the carrying bar 4, so that the beverage container 3 braced on the clamping spring 11 becomes fixed in the new position.

Figure 1C:
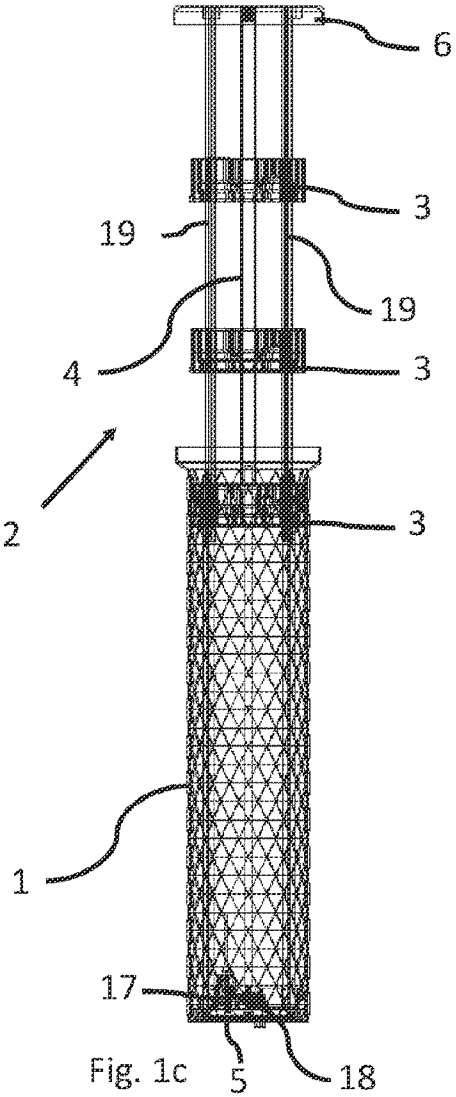
Figure 1B:
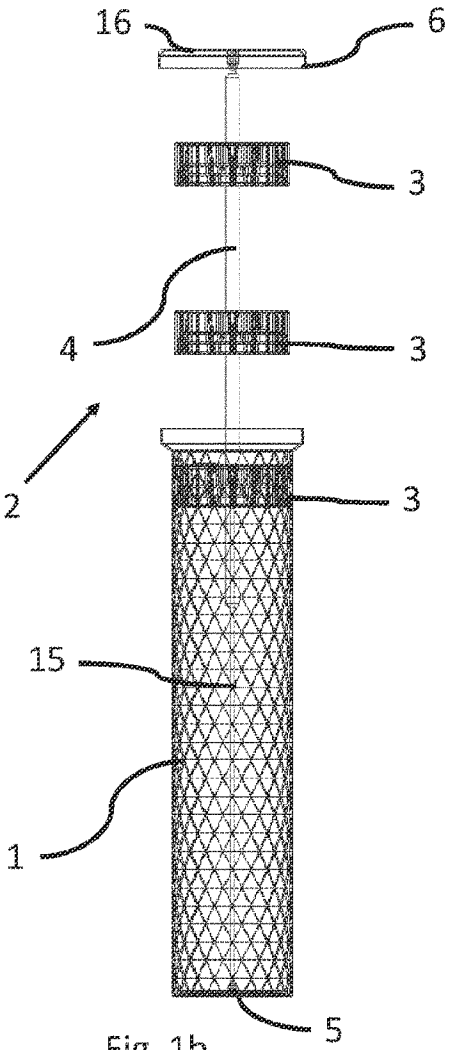
Figure 1A:
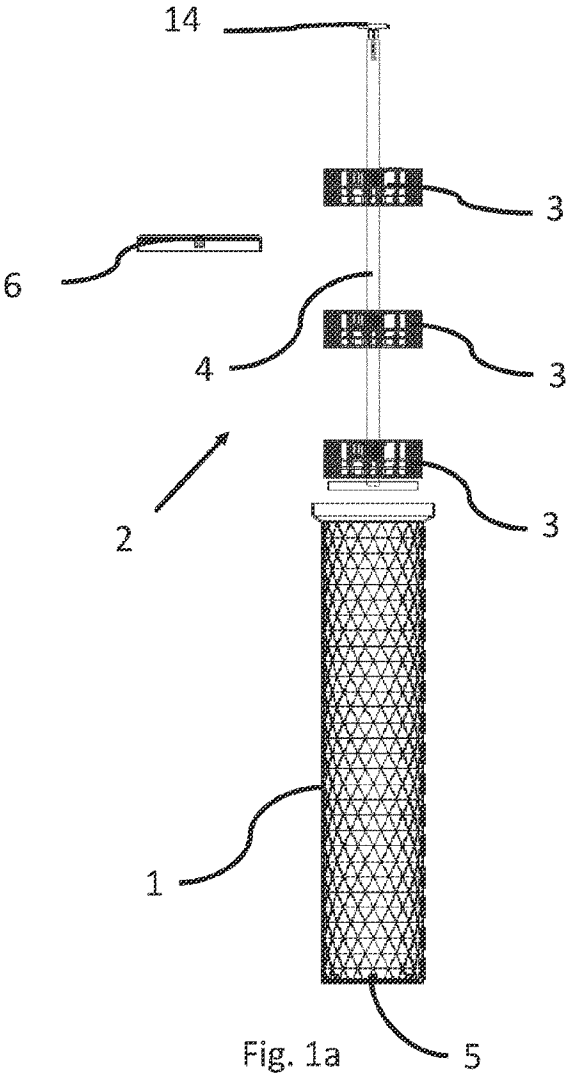
Figure 2:
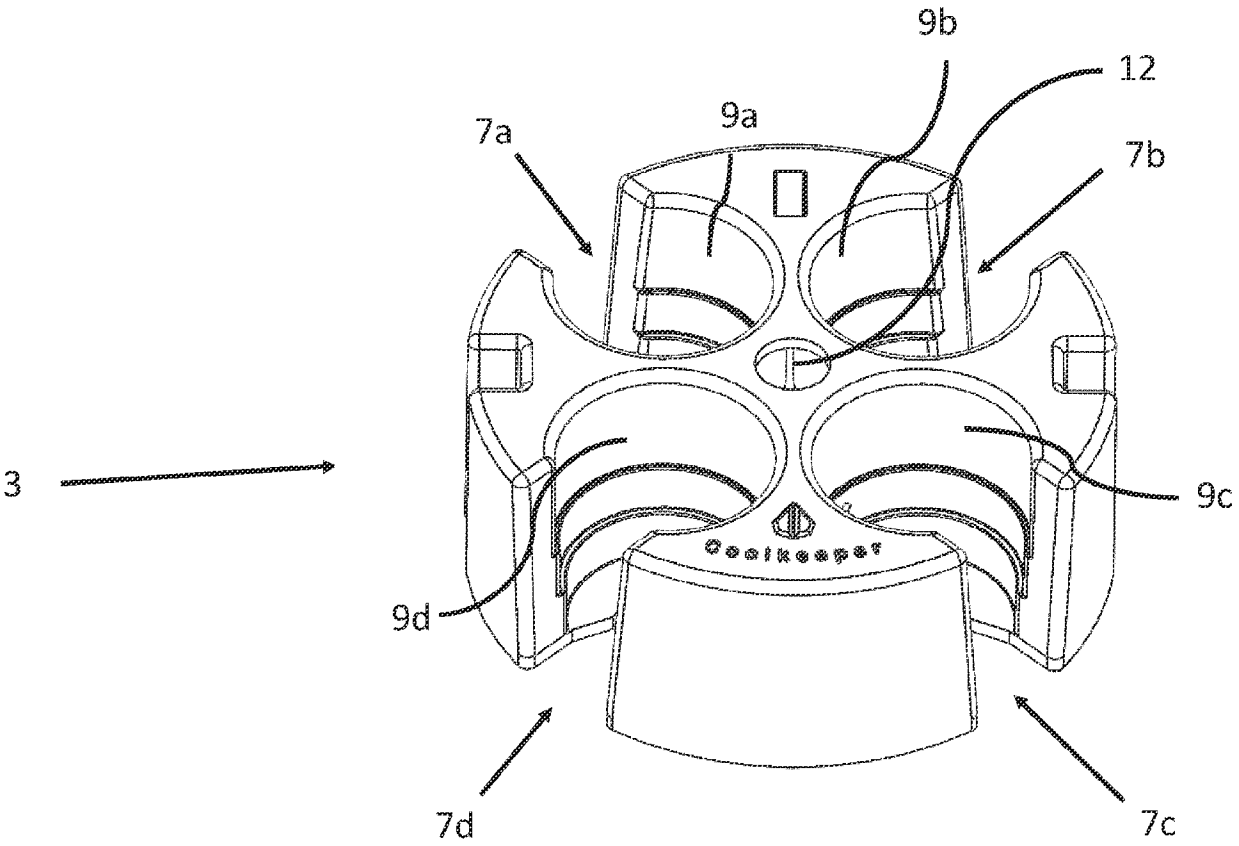
FIG. 2 shows one of the beverage holders in perspective.
Figure 3:
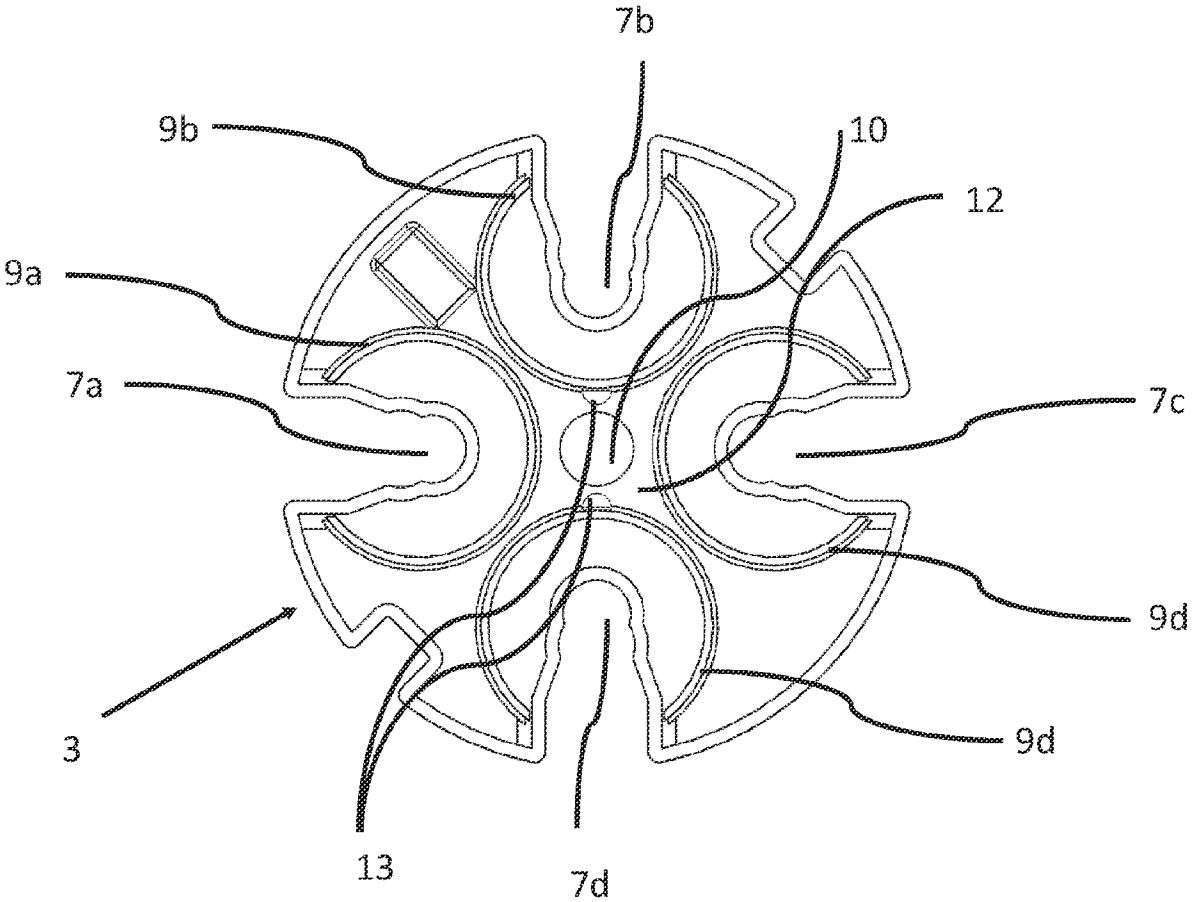
FIG. 3 shows the beverage holder illustrated in FIG. 2 in a view from underneath.
Figure 5:
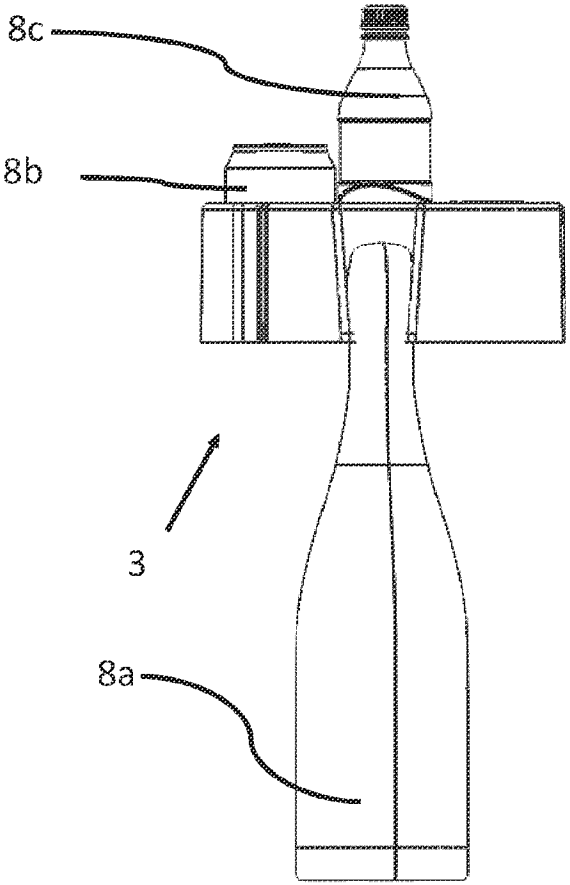
FIG. 5 shows a side view corresponding to FIG. 4.
Figure 4:
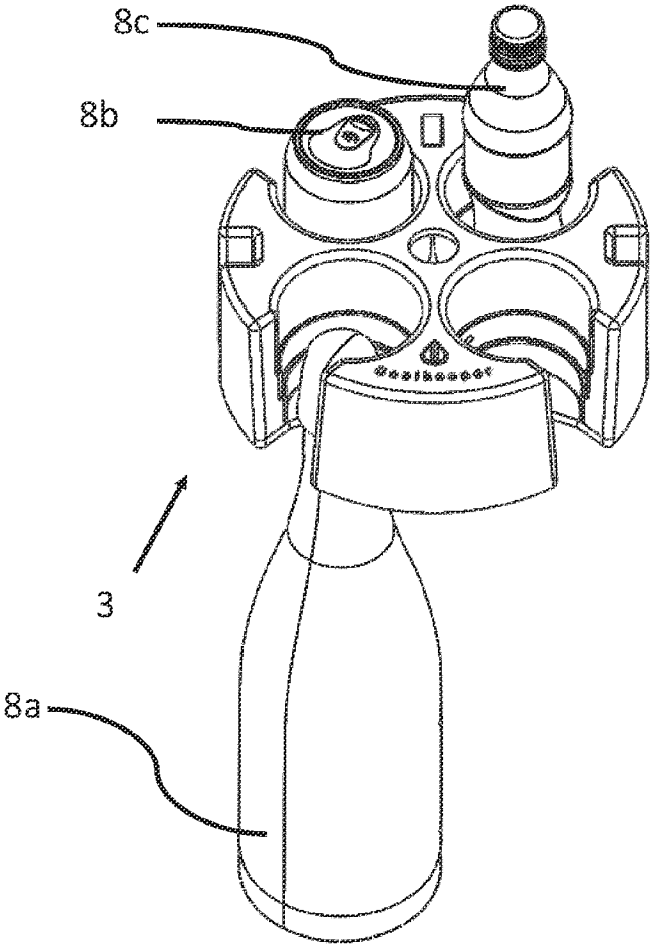
FIG. 4 shows one of the beverage holders loaded with various beverage containers in perspective.
Figure 6:
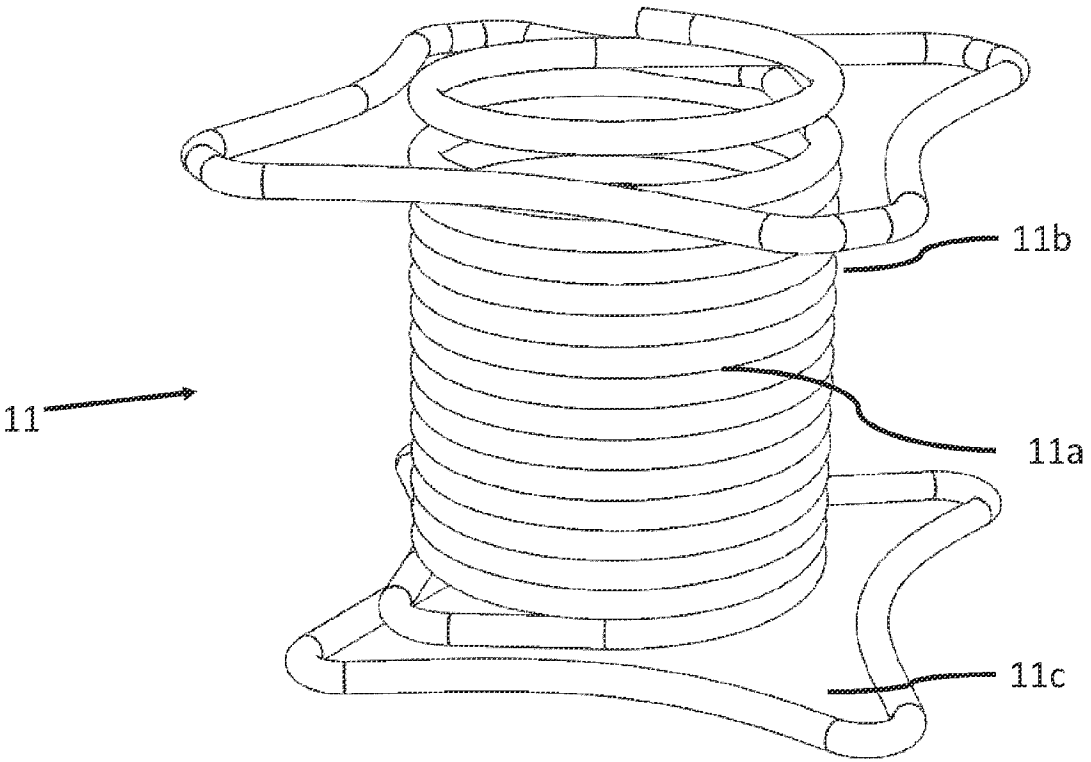
FIG. 6 shows a side view of one of the clamping springs.
Figure 7:
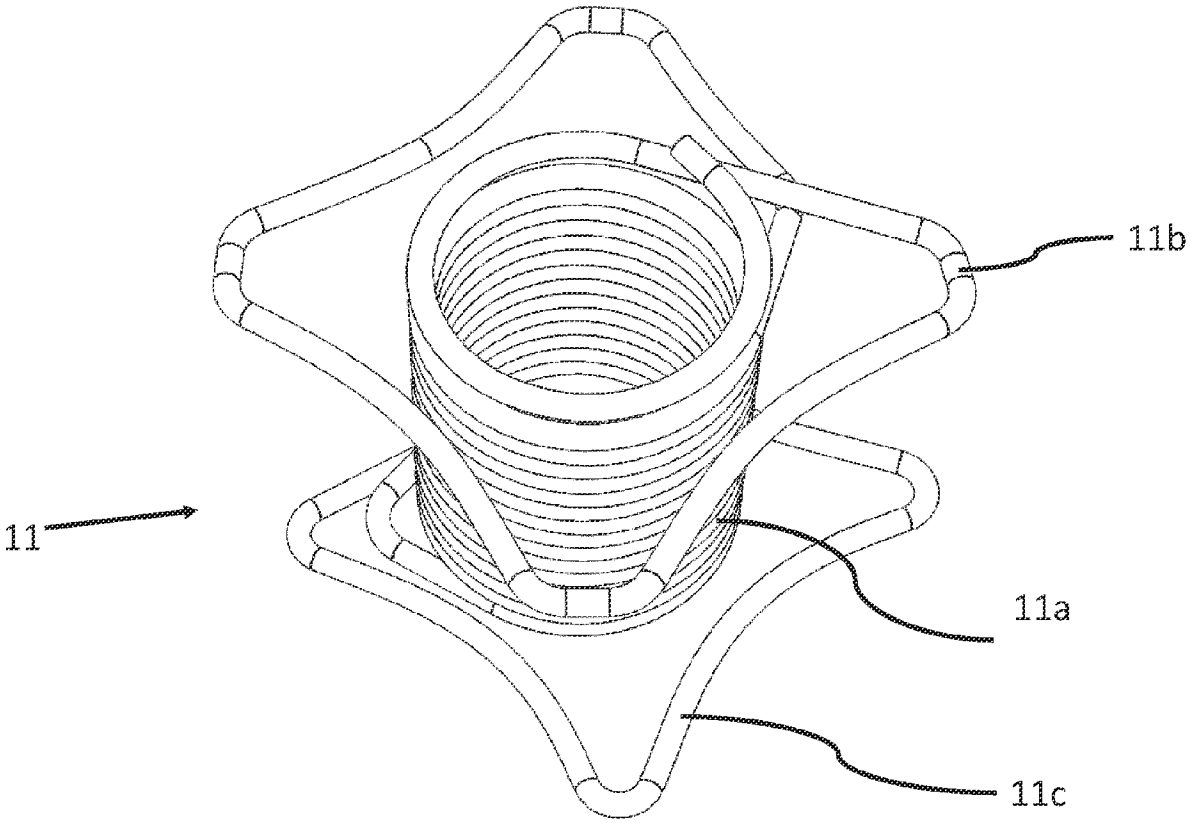
FIG. 7 shows the clamping spring illustrated in FIG. 6 in perspective.

For lifting of the entire carrying device 2 together with the beverage holders 3 fastened on it, its carrying bar 4 is equipped at the upper end with a handle (see FIG. 1*a*).

In order to facilitate and at least partly automate the process of extraction of the support device 2, its carrying bar 4 is connected to the cover 6 of the jacket tube 1 and equipped with a pneumatic spring 15, which is braced on the base 5 of the jacket tube 1 (see FIG. 1*b*). During actuation of this pneumatic spring 15, a movable overall unit, consisting of the carrying bar 4, the beverage holders 3 loaded with beverage containers 8 and the cover 6, is lifted out of the jacket tube 1 buried in the ground in such a way that all of the beverages held in stock in the beverage cooler become accessible for consumption.

For initiation and termination of these movement processes, the pneumatic spring is equipped with a depressible switching element 16, which—in the manner of a ballpoint pen mechanism—alternately and successively locks and releases the pneumatic spring 15.

An alternative to the semi-automatically assisted movement of the carrying device 2 explained above provides that the complete carrying device 2 is extracted and inserted with the aid of an electromotive rotary spindle drive 17 braced on the base 5 of the jacket tube 1 (see FIG. 1*c*). Moreover, during the use of such a rotary spindle drive 17, the carrying device 2 is guided in a twist-proof manner on the wall of the jacket tube 1 by corresponding guide rails 19.

The invention claimed is:

1. A hole-in-the-ground beverage cooler with a jacket tube of plastic, which beverage cooler can be inserted vertically into a hole in the ground, which beverage cooler is equipped at the bottom with a tightly sealing base and at the top with a lift-off cover and in an inner space of said beverage cooler, a carrying device is disposed that can be moved axially upward out of the jacket tube and on which carrying device several disk-shaped beverage holders are disposed, which beverage holders have axial distance from one another, can be pushed into the jacket tube, are fastened to the carrying device, and are respectively equipped with several hanger openings disposed in distributed manner over the circumference of a beverage holder of said beverage holders and accessible from the periphery of the beverage holder for hanging the bottle necks of beverage bottles, wherein the beverage holders are respectively equipped at the hanger openings with cylinder-shell-shaped bracing walls, open toward the periphery of the beverage holder, for bracing of beverage containers, which beverage containers can be inserted from above into the beverage holder.

2. The hole-in-the-ground beverage cooler according to claim 1, wherein the cylinder-shell-shaped bracing walls have a radius of curvature that increases stepwise with increasing distance from the hanger openings.

3. The hole-in-the-ground beverage cooler according to claim 1 or 2, wherein the beverage holders are respectively manufactured as one-piece castings of plastic.

4. The hole-in-the-ground beverage cooler, especially according to claim 1, wherein the carrying device of the hole-in-the-ground beverage cooler has a carrying bar, which carrying bar can be moved axially out of the jacket tube and on which the beverage holders can be displaced in axial direction and fixed in infinitely variable position.

5. The hole-in-the-ground beverage cooler according to claim 4, wherein the beverage holders respectively have a central passage opening for the carrying bar, and wherein a clamping spring bracing the beverage holder and clamping it securely to the carrying bar at any desired height is respectively disposed underneath the beverage holder.

6. The hole-in-the-ground beverage cooler according to claim 5, wherein the clamping spring is designed as a leg spring having several spring coils bearing axially against one another and surrounding the carrying bar, the inside diameter of which is smaller than the outside diameter of the carrying bar when the clamping spring is relaxed, wherein the upper spring leg of this clamping spring is braced in twist-proof manner on the underside of the beverage holder and the lower spring leg of this clamping spring is designed as a handle, which serves to transmit a torque that tensions the clamping spring.

7. The hole-in-the-ground beverage cooler according to claim 6, wherein receiving openings for the accommodation and fixation of the upper spring leg of the clamping spring are respectively disposed on the undersides of the beverage holder, wherein these receiving openings respectively have at least one undercut, in which the upper spring leg of the clamping spring can be elastically latched.

8. The hole-in-the-ground beverage cooler according to claim 4, wherein the carrying bar is equipped at its upper end with a handle for lifting the carrying device out of the jacket tube.

9. The hole-in-the-ground beverage cooler according to claim 4, wherein the carrying bar of the carrying device is connected at the top to the cover of the jacket tube and is equipped with a pneumatic spring, which serves to lift the carrying device out of the jacket tube and is braced on the base of the jacket tube.

10. The hole-in-the-ground beverage cooler according to claim 9, wherein the cover of the jacket tube is equipped with a depressible switching element for release and locking of the pneumatic spring in alternating succession.

11. The hole-in-the-ground beverage cooler according to claim 1, wherein the carrying device is assigned an electric rotary spindle drive braced on the base of the jacket tube and used for lifting of the carrying device out of the jacket tube or for lowering of the carrying device into the jacket tube.

12. The hole-in-the-ground beverage cooler according to claim 11, wherein the carrying device is additionally guided in twisting-proof manner on the wall of the jacket tube.

13. The hole-in-the-ground beverage cooler according to claim 1, wherein the base, tightly sealing the jacket tube at the bottom, is designed as a metal plate screwed together with the jacket tube.

14. The hole-in-the-ground beverage cooler according to claim 9, wherein the bracing of the pneumatic spring on the base of the jacket tube takes place via a ball joint.

* * * * *